US005291215A

United States Patent [19]

Nozawa et al.

[11] Patent Number: 5,291,215

[45] Date of Patent: Mar. 1, 1994

[54] INK JET RECORDING APPARATUS WITH A THERMALLY STABLE INK JET RECORDING HEAD

[75] Inventors: Minoru Nozawa, Machida; Yutaka Koizumi, Tokyo; Toshihiro Mori, Kawasaki; Atsushi Saito, Yokohama, all of Japan

[73] Assignee: Canon Kabushiki Kaisha, Tokyo, Japan

[21] Appl. No.: 765,468

[22] Filed: Sep. 26, 1991

Related U.S. Application Data

[63] Continuation of Ser. No. 410,514, Sep. 21, 1989, abandoned, which is a continuation of Ser. No. 271,645, Nov. 16, 1988, Pat. No. 4,896,172.

[30] Foreign Application Priority Data

Nov. 20, 1987 [JP] Japan ..... 62-291963
Nov. 20, 1987 [JP] Japan ..... 62-291967

[51] Int. Cl.[5] ..... B41J 2/18; B41J 2/05
[52] U.S. Cl. ..... 346/1.1; 346/140 R
[58] Field of Search ..... 346/140, 1.1

[56] References Cited

U.S. PATENT DOCUMENTS 4,007,465 2/1977 Chaudhary ..... 346/140
4,296,421 10/1981 Hara ..... 346/140
4,317,124 2/1982 Shirato ..... 346/140
4,568,953 2/1986 Aoki ..... 346/140
4,658,272 4/1987 Toganoh et al. ..... 346/140 R
4,680,696 7/1987 Ebinuma et al. ..... 346/75
4,704,620 11/1987 Ichihashi et al. ..... 346/140 R
4,737,801 4/1988 Ichihashi et al. ..... 346/140 R
4,791,440 12/1988 Eldridge et al. ..... 346/140 R
4,896,172 1/1990 Nozawa et al. ..... 346/140 R

FOREIGN PATENT DOCUMENTS 56-44664 12/1979 Japan .
56-86762 12/1979 Japan .
57-193371 5/1981 Japan .
61-206658 3/1986 Japan .
206658 10/1992 Japan .

*Primary Examiner*—Joseph W. Hartary
*Attorney, Agent, or Firm*—Fitzpatrick, Cella, Harper & Scinto

[57] ABSTRACT

A liquid jet recording apparatus has a full-line type recording head with discharge ports across a recording medium, a liquid path communicating with the discharge ports and having a thermal energy generating member for generating energy utilized to discharge recording liquid, a common liquid chamber for storing liquid to be supplied to the liquid path, the energy generating member, liquid path and common liquid chamber being disposed on one side of a substrate, and a storing tank for storing the recording liquid to be supplied to the recording head. Another liquid chamber is disposed on the other side of the substrate and is independent of the common liquid chamber. A temperature sensor detects the temperature of the recording head and recording liquid is circulated in the chamber when the temperature of the recording head exceeds a predetermined limit. A fan supplies cooling air in response to the circulation of recording liquid.

16 Claims, 6 Drawing Sheets

INK JET RECORDING APPARATUS WITH A THERMALLY STABLE INK JET RECORDING HEAD

This application is a continuation of application Ser. No. 07/410,514 filed Sep. 21, 1989, now abandoned, which in turn is a continuation of application Ser. No. 07/271,645 filed Nov. 16, 1988, now U.S. Pat. No. 4,896,172.

BACKGROUND OF THE INVENTION

1. Field of the Invention

The present invention relates to a liquid injection recording apparatus in, and, more particularly, it relates to a liquid injection recording apparatus which the recording is effected by liquid drops discharged from discharge ports.

2. Related Background Art

As a conventional liquid injection recording apparatus of this kind, a recording apparatus wherein minute liquid drops are discharged by creating pressure change in liquid passages due to the deformation of piezo-electric elements, and a recording apparatus wherein a pair of electrodes are further provided for deflecting liquid drops when discharged, have been already known. Further, various recording systems such as a recording apparatus wherein exothermic elements are arranged in liquid passages and liquid drops are discharged from discharge ports by bubbles generated by suddenly heating such exothermic elements have been proposed.

Among these conventional recording apparatuses, the last mentioned recording system, i.e., the system that utilizes thermal energy to discharge the liquid drops is particularly effective in that it is easy to arrange the discharge ports with high density and it is possible to record at a high speed. Further, as recording heads applicable to such a recording apparatus, a recording head of serial scanning type and a recording head of full-multi (full-line) type such that the discharge ports are arranged in correspondence to a width of the record are already known. Among them, the recording head of full-multi type is apparently effective in the high speed recording operation.

However, in the recording head used with the above-mentioned recording apparatus that utilizes thermal energy, when a high density recording operation such as a solid recording operation, particularly a high speed recording operation by high-frequency drive is carried out, there arise problems that the temperature of the recording head is excessively increased due to excessive heat which is not utilized to record (i.e., to form the liquid drops), thus changing the viscosity of the recording liquid or generating dissolved bubbles in the recording liquid, and that the formation of desired bubbles cannot be obtained when the temperature of the recording head is increased more than a certain value T1. The excessive temperature increase in the recording head often makes difficult the formation of the proper or normal liquid drops and/or changes the diameter of a dot, thus deteriorating the quality of the record. Further, since the bubbles (dissolved bubbles) created by releasing dissolved gas in the recording liquid do not vanish immediately, they remain in the recording head for a long time. As a result, they absorb the sudden pressure change required for forming the liquid drops due to the formation of bubbles, thus often resulting non-discharge of the liquid drops.

For these reasons, in the conventional recording apparatus, in order to cope with the above problems and disadvantages, when the temperature of the recording head reached a predetermined value T2 set lower than the temperature T1, the recording operation was temporarily stopped until the recording head was cooled to a certain temperature, and thereafter the recording operation was started again. Particularly, such temperature increase should cause a remarkable problem, since when the recording head is of full-multi type including the recording system for forming the liquid drops by utilizing thermal energy, the number of the exothermic elements (heating elements) may be a few thousand. However, if the recording operations are temporarily stopped, the advantage of high speed recording is lost, even when the recording system for permitting the high speed recording operation is used, the ability of such a recording system cannot be effectively utilized.

SUMMARY OF THE INVENTION

Accordingly, an object of the present invention is to provide a liquid injection recording apparatus adapted particularly for a full-multi type recording system for performing the recording operation by means of drops of the recording liquid discharged by utilizing thermal energy, which can quickly reduce the temperature of a recording head even if the temperature of the recording head is increased, thus restoring recording ability quickly to utilize the whole ability of the recording head, thereby performing a high speed recording operation with high quality.

To achieve the above-mentioned object, a liquid injection recording apparatus according to the present invention is so constructed as to prevent the increase in temperature of recording liquid in a recording head, or of the recording head itself, by circulating the recording liquid which is supplied to a common liquid chamber formed in the recording head, between the common chamber and a recording head storing tank.

Further, a liquid injection recording apparatus according to the present invention for achieving the above-mentioned object is so constructed as to prevent the increase in temperature of recording liquid in a recording head or of the recording head itself by circulating the recording liquid which is supplied to a secondary chamber and/or a common chamber formed in the recording head, between the secondary and/or common chamber and a recording liquid storing tank.

According to the present invention, the temperature of the recording head can be quickly lowered to a desired range of temperature, even when the temperature of the recording head increases above a predetermined value.

Further, since the temperature of the recording head can easily be restored to the desired range of temperature quickly, the recording ability can also be restored in a very short time, thus fully utilizing the latent recording faculties of a recording system for performing the recording operation by means of drops of the recording liquid discharged by utilizing thermal energy, thereby realizing a more high speed recording operation with high quality.

In accordance with a specific aspect of the invention, an ink jet recording apparatus comprises a recording head of a full-line type having a plurality of discharge ports provided across a recording medium, a liquid path communicated with the discharge ports and having a thermal energy generating member for generating energy utilized to discharge recording liquid, and a common liquid chamber for storing liquid to be supplied to the liquid path, wherein the energy generating member, the liquid path and the common liquid chamber are disposed on one side of a substrate; a chamber disposed on a reverse side of the substrate with respect to the one side of the substrate and extending along the longitudinal direction of the recording head for containing moving liquid therein, the chamber being provided independently from the common chamber; a temperature sensor which detects the temperature of the recording head during recording wherein the recording liquid is circulated when the temperature sensor detects that the temperature of the recording head exceeds a predetermined temperature; and fan means for supplying cooling air in response to circulation of recording liquid.

In accordance with another specific aspect of the invention, an ink jet recording apparatus comprises a recording head of a full-line type having a plurality of discharge ports provided across a recording medium, a liquid path communicated with the discharge ports and having a thermal energy generating member for generating energy utilized to discharge recording liquid, and a common liquid chamber for storing liquid to be supplied to the liquid path, wherein the energy generating member, the liquid path and the common liquid chamber are disposed on one side of a substrate; a chamber disposed on an area which is on a reverse side of the substrate with respect to the one side of the substrate and opposed to the energy generating member through said substrate, and extending along the longitudinal direction of the recording head for containing moving liquid therein, the chamber being provided independently from the common liquid chamber, wherein a first liquid flow is formed in a first direction with respect to an arrangement direction of the thermal energy generating member in the common liquid chamber, and a second liquid flow is formed in a second direction opposite to the first direction in the chamber; a temperature sensor which detects the temperature of the recording head during recording, wherein the recording liquid is circulated when the temperature sensor detects that the temperature of the recording head exceeds a predetermined temperature; and fan means for supplying cooling air in response to the circulation of recording liquid in the first flow path and the second flow path.

In accordance with yet another specific aspect of the invention, a recording head comprises a plurality of heat generating elements provided in a predetermined distribution to record by generating heat; a liquid path, having the heat generating elements therein, for guiding recording liquid discharged from a discharge port by utilizing thermal energy generated by the heat generating elements; a first flow path communicating with the liquid path to supply the recording liquid to the liquid path, for forming a first liquid flow in a direction across the liquid path; a second flow path provided independently from the first flow path through a substrate containing the heat generating elements, for forming a second liquid flow in a direction opposite to the direction of said first liquid flow; a temperature sensor which detects the temperature of the recording head during recording, wherein the recording liquid is circulated when the temperature sensor detects that the temperature of the recording head exceeds a predetermined temperature; and fan means for supplying cooling air in response to the circulation of recording liquid in the first flow path and in the second flow path.

DETAILED DESCRIPTION OF THE PREFERRED EMBODIMENTS

The present invention will now be explained in connection with the accompanying drawings.

First of all, a liquid injection recording apparatus according to a first embodiment of the present invention will be explained below with reference to FIGS. 1A–1C and FIG. 2.

Figure 1A:
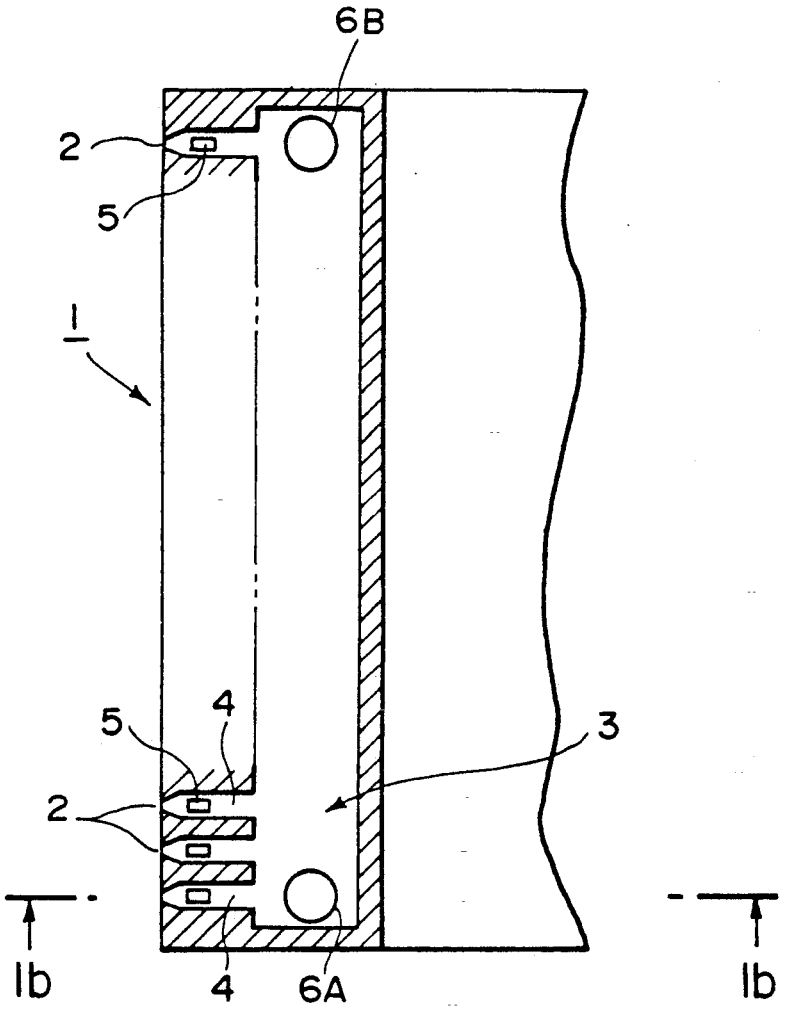
FIG. 1A is a schematic partial sectional view of a main portion of a recording head used with a liquid injection recording apparatus according to a first embodiment of the present invention.
Figure 1B:
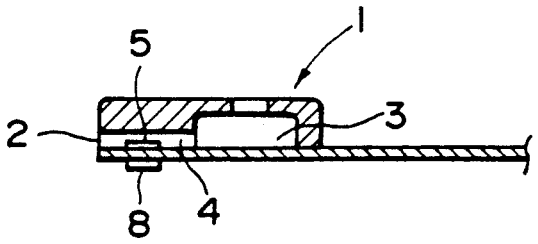
FIG. 1B is a schematic sectional view of the recording head taken along the line 1*b*–1*b* of FIG. 1A.
Figure 1C:
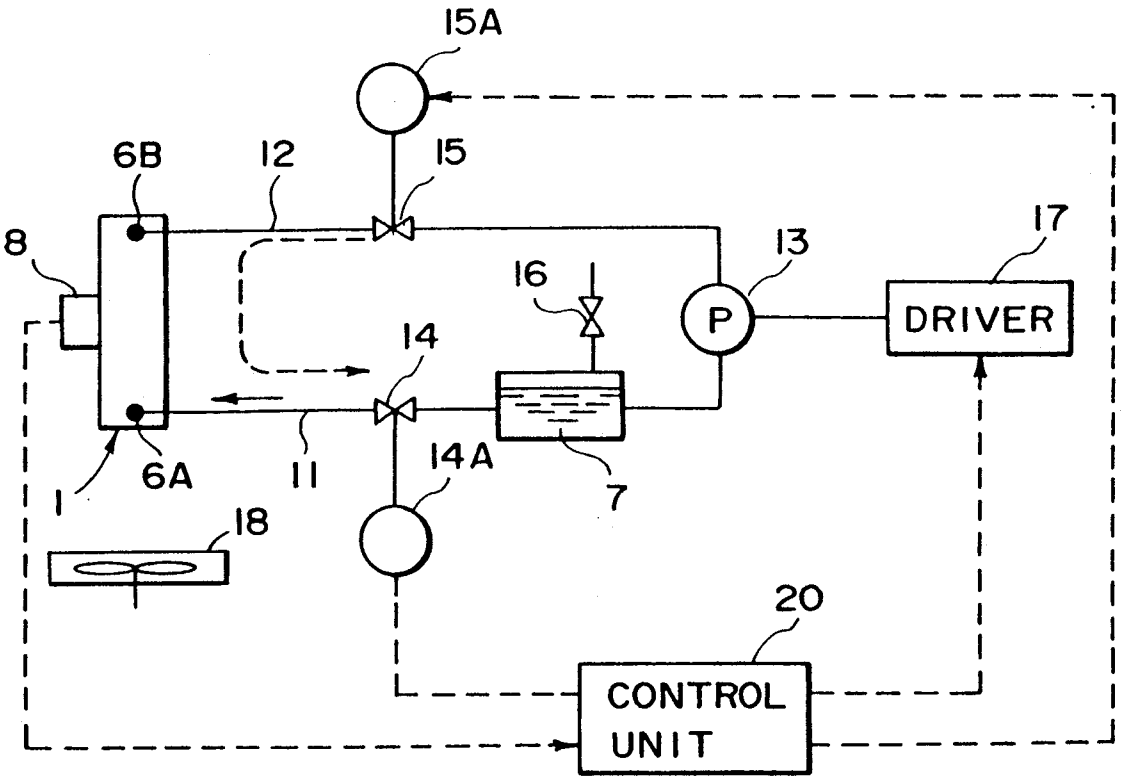
FIG. 1C is a block diagram showing a preferred example of a construction of a recording liquid supplying, cooling and circulating device used with the recording apparatus of the first embodiment.

FIGS. 1A–1C show a first embodiment of the present invention. In FIGS. 1A and 1B, a recording head 1 of full-multi type can move relative to a recording medium (not shown) to record images on the recording medium by discharging recording liquid from discharge ports 2 facing the recording medium, in response to recording signals. The recording head 1 includes a common liquid chamber 3 formed therein, and a plurality of liquid passages 4 for directing the recording liquid from the common chamber 3 to the corresponding discharge ports 2. Exothermic or heating elements 5 (for example, electrical-thermal converters) are arranged in the corresponding liquid passages 4 arranged at predetermined intervals as shown in FIG. 1A. The common liquid chamber 3 includes a supply port 6A through which the recording liquid is supplied to the common chamber 3, and a return port 6B for returning the recording liquid from the common chamber 3 to a recording liquid storing tank 7 (FIG. 1C) (referred to as merely "tank" hereinafter). Further, in the illustrated first embodiment, a temperature sensor 8 is mounted on the back of a wall of the recording head 1 (opposite to the heating elements 5) in confronting relation to the heating elements 5 in the liquid passages 4, as shown in FIG. 1B.

FIG. 1C shows a recording liquid supplying and circulating system associated with the so constructed recording head 1. The reference numeral 11 designates a supply conduit for supplying the recording liquid from the tank 7 to the recording head 1, and the reference numeral 12 designates a circulating conduit for supplying the recording liquid to the head 1 and returning the recording liquid to the tank 7 by means of a pump 13 when the head 1 is cooled, as described later. The supply conduit 11 and the circulating conduit 12 are provided with valves such as solenoid valves 14 and 15, respectively. The tank 7 includes a vent valve 16. The pump 13 is driven by a driver 17, and the solenoid valves 14, 15 are controlled by corresponding switch elements 14A and 15A, respectively. A control unit 20 controls the energization and deenergization of the solenoid valves 14, 15 and pump 13 in response to a temperature detect signal from the temperature sensor 8, as will be described later.

Figure 2:
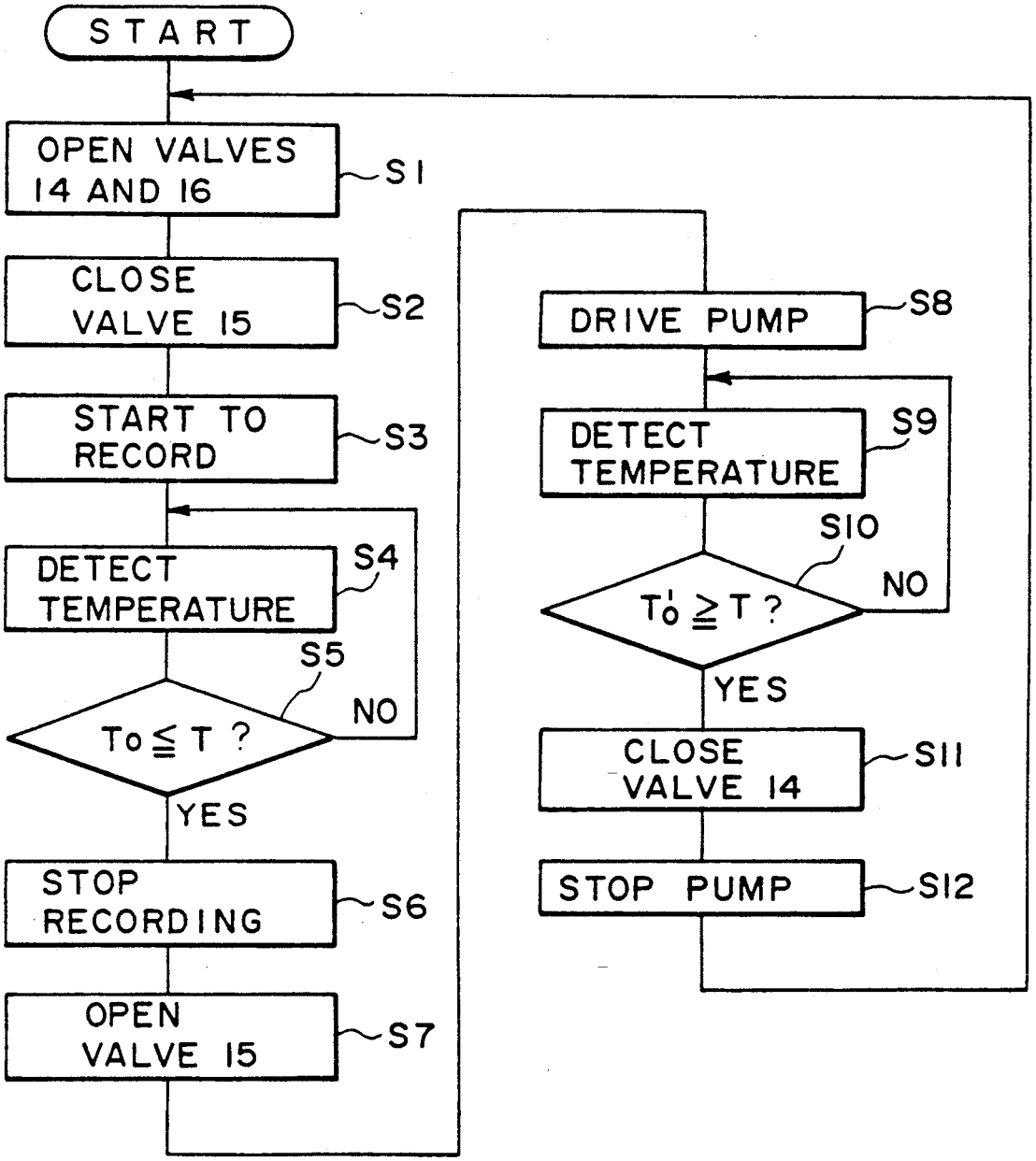
FIG. 2 is a flow chart for explaining an example of a control sequence of the liquid injection recording apparatus of the first embodiment.

Next, the control sequence of the recording apparatus according to the first embodiment will be explained with reference to FIG. 2.

When the recording operation is desired to start, the solenoid valve 14 and the vent valve 16 are opened in a step S1, and the solenoid valve 15 is closed in a next step S2. Then, the recording head 1 is driven to start the recording operation in a step S3, and then the temperature of the head 1 is detected by the temperature sensor 8 in a step S4. Thereafter, a step S5 determines whether the detected temperature T of the recording head 1 reaches an upper permissible limit temperature $T_0$ on the basis of the temperature detect signal from the temperature sensor 8, and monitors the head until the detected temperature T reaches the upper limit temperature $T_0$. And, if the step S5 judges that the temperature T has reached the temperature $T_0$, the sequence goes to a step S6, where the recording operation is temporarily stopped. Then, the sequence immediately goes to a step S7, where the solenoid valve 15 associated with the supply conduit 11 is opened. Then, in a step S8 the pump 13 is driven to circulate the recording liquid between the tank 7 and the common liquid chamber 3 of the recording head 1 in a direction shown by a broken line in FIG. 1C, while detecting the temperature again in a step S9. A step S10 determines whether the detected temperature T reaches a lower limit temperature $T_0'$ suitable to the recording operation. The circulation of the recording liquid is continued until the detected temperature T reaches the lower limit temperature $T_0'$. When it is judged that the temperature T has reached the temperature $T_0'$, the solenoid valve 14 associated with the supply conduit 11 is closed in a step S11, and the pump 13 is disenergized in a step S12. Then, the sequence returns to the step S1. Further, in a restoring operation for positively discharging the recording liquid from the discharge ports 2 under pressure, such restoring operation may be performed at a point that the valve 14 is closed in the step S11.

In the illustrated first embodiment, although an example that the recording head 1 is cooled through the recording liquid only by the circulation of the recording liquid by means of the pump 13 was described, it is possible to further provide a fan 18, shown in FIG. 1C, to cool the recording head 1 directly while circulating the recording liquid or to cool the recording liquid being circulated, thus shortening the cooling time and accordingly, shut-down time of the apparatus, thereby improving the efficiency of the recording operation.

Of course, the temperature when the circulation of the recording liquid is stopped is not limited to the above-mentioned lower limit temperature $T_0'$ suitable to the recording operation. That is to say, such temperature can be set to any temperature $T_0''$ between the lower limit temperature $T_0'$ suitable to the recording operation and the upper limit temperature $T_0$. In other words, the temperature $T_0''$ may meet the relation $T_0' \leqq T_0'' \leqq T_0$. However, if the temperature $T_0''$ is near the temperature $T_0$, since the liquid circulation mode is started again shortly after the recording operation is re-started, the temperature $T_0''$ should preferably be set to a value near the temperature $T_0'$, and more preferably set to the relation $T_0''=T_0'$. However, since it may be the case that the temperature of the recording head cannot be lowered to the temperature $T_0'$ by the circulation of the recording liquid, it is desirable to set temperature $T_0''$ properly.

As mentioned above, according to the first embodiment of the present invention, even if the temperature of the recording head is increased, since the recording head can be quickly cooled through the recording liquid by circulating the recording liquid between the common liquid chamber in the recording head and the tank by means of the pump, even when the recording operation is temporarily stopped, the recording operation can quickly be re-started, thus carrying out the high speed recording operation effectively with high quality while maintaining stable discharging operation of the liquid.

Further, an amount of the recording liquid to be circulated can be suitably selected experimentally on the basis of the cooling ability of the liquid; however, it is desirable to set the circulating amount of the liquid to the extent that the recording liquid does not leak from the discharge openings while being circulated, thus shortening the shut-down time of the apparatus and preventing contamination of the recording medium.

Next, a liquid injection recording apparatus according to a second embodiment of the present invention will now be explained with reference to FIGS. 3A–3C and FIG. 4.

Figure 3A:
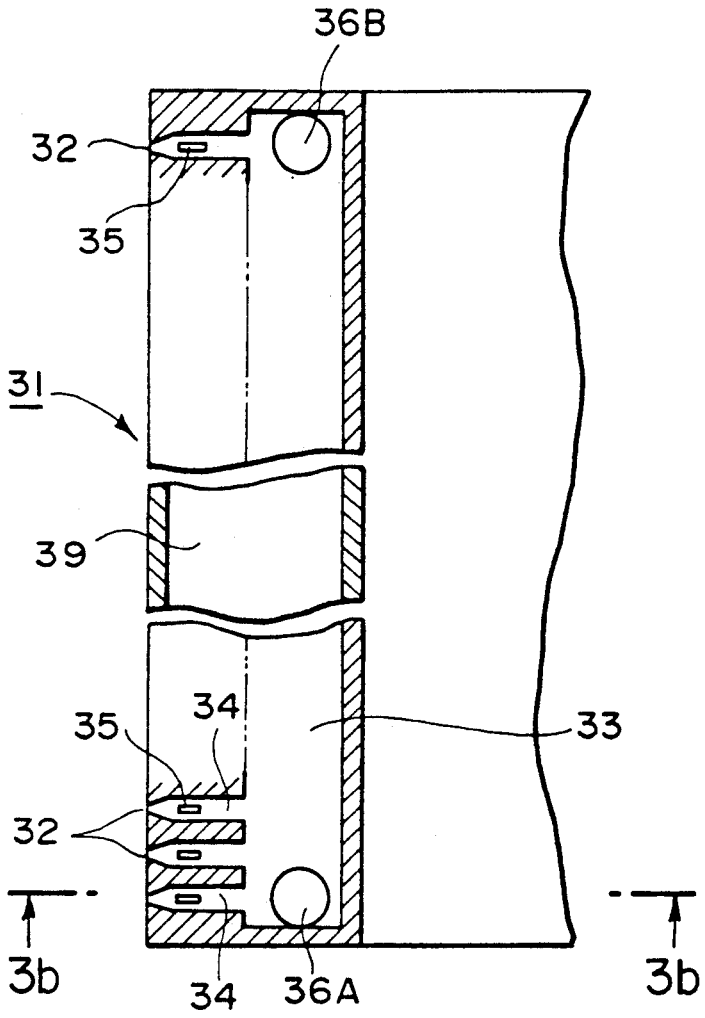
FIG. 3A is a schematic partial sectional view of a main portion of a recording head used with a liquid injection recording apparatus according to a second embodiment of the present invention.
Figure 3B:
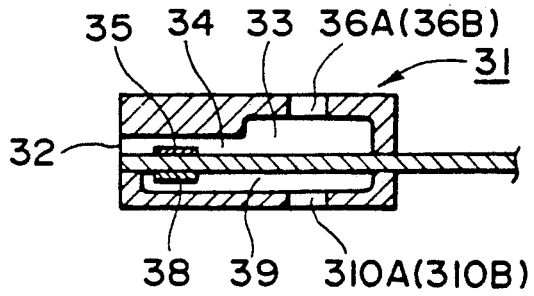
FIG. 3B is a schematic sectional view of the recording head taken along the line 3*b*–3*b* of FIG. 3A.
Figure 3C:
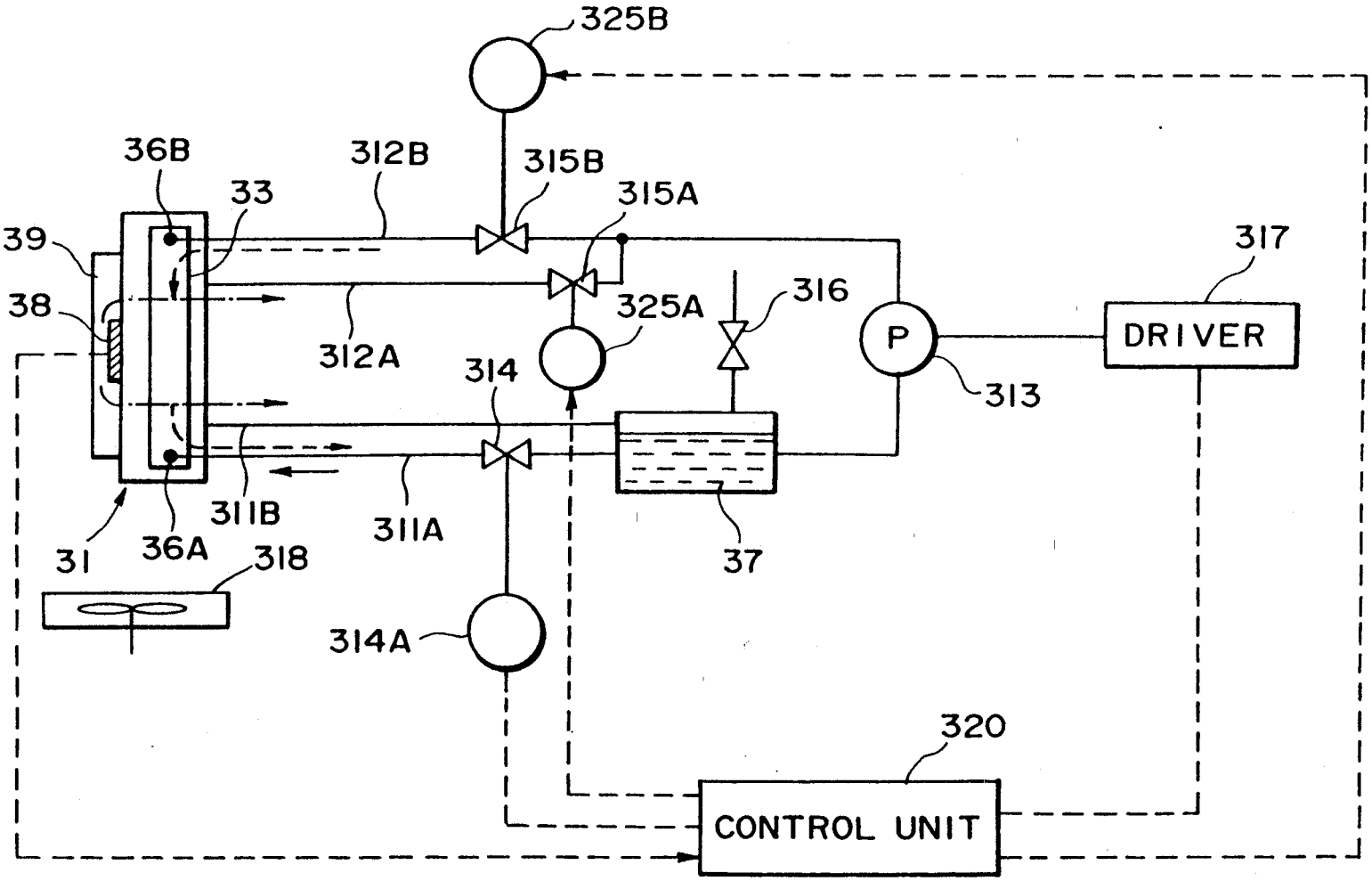
FIG. 3C is a block diagram showing a preferred example of a construction of a recording liquid supplying, cooling and circulating device used with the recording apparatus of the second embodiment.

FIGS. 3A–3C show a second preferred embodiment of the present invention. In FIGS. 3A and 3B, a recording head 31 of full-multi type can move relative to a recording medium (not shown) to record images on the recording medium by discharging recording liquid from discharge ports 32 facing the recording medium, in response to recording signals. The recording head 31 includes a common liquid chamber 33 formed therein, and a plurality of liquid passages 34 for directing the recording liquid from the common chamber 33 to the corresponding discharge openings 32. Heating elements 5 are arranged in the corresponding liquid passages 34 arranged at predetermined intervals as shown in FIG. 3A. The common liquid chamber 33 includes a supply port 36A through which the recording liquid is supplied to the common chamber 33, and a second feed port 36B for feeding the recording liquid from a recording liquid storing tank 37 (FIG. 3C) (referred to as merely "tank" hereinafter) to the common chamber 33 when the recording liquid is circulated through the common liquid chamber 33. Further in the illustrated second embodiment, as shown in FIG. 3B, a temperature sensor 38 is mounted on the back of a wall of the recording head 31 opposite to the liquid passages 34, and a secondary chamber 39 is formed to enclose the temperature sensor. The secondary chamber 39 is provided at its both ends with a supply port 310A for supplying the recording liquid to the chamber 39 and a return port 310B for returning the recording liquid to the tank 37.

FIG. 3C shows a recording liquid supplying, cooling and circulating system associated with the so constructed recording head 31. The reference numeral 311A designates a supply conduit for supplying the recording liquid from the tank 37 to the recording head 31, and the reference numeral 311B designates a return conduit for returning the recording liquid from the secondary chamber 39 to the tank 37. The reference numeral 312A designates a feed conduit for supplying the recording liquid to the secondary chamber 39 of the recording head 31 by means of a pump 313 when the head 31 is cooled, and the reference numeral 312B designates a second feed conduit for feeding the recording liquid to the common liquid chamber 33 of the head 31 when the recording liquid is circulated. The supply conduit 311A, the cooling feed conduit 312A and the circulating second feed conduit 312B are provided with valves such as solenoid valves 314, 315A and 315B, respectively. The tank 37 includes a vent valve 316. The pump 313 is driven by a driver 317, and the solenoid valves 314, 315A and 315B are controlled by corresponding switch elements 314A, 325A and 325B, respectively. A control unit 320 controls the energization and disenergization of the solenoid valves 314, 315A, 315B and pump 313 in response to a temperature detect signal from the temperature sensor 38, as will be described later.

Next, the control sequence of the recording apparatus according to the second embodiment will now be explained with reference to FIG. 4.

When the recording operation is desired to start, the solenoid valve 314 and the vent valve 316 are opened in a step S31, and the solenoid valves 315A and 315B are closed in a next step S32. Then, the recording head 31 is driven to start the recording operation in a step S33, and then the temperature of the recording head 31 is detected by the temperature sensor 38 in a step S34. Thereafter, a step S35 determines whether the detected temperature T of the recording head 31 reaches a predetermined upper limit temperature $T_0$ on the basis of the temperature detect signal from the temperature sensor 38, and monitors the head until the detected temperature T reaches the upper limit temperature $T_0$. And, if the step S35 judges that the temperature T has reached the upper limit temperature $T_0$, the sequence goes to a step S36, where the solenoid valve 315A associated with the cooling feed conduit 312A is opened. Then, in a step S37 the pump 313 is driven to circulate the recording liquid between the tank 37 and the secondary chamber 39 of the recording head 31 in a direction shown by a chain and dot line in FIG. 3C, while detecting the temperature again in a step S38. A step S39 determines whether the detected temperature T reaches a predetermined lower limit temperature $T_0'$ suitable to the recording operation. The circulation of the recording liquid is continued until the detected temperature T reaches the lower limit temperature $T_0'$. When it is judged that the temperature T has reached the lower limit temperature $T_0'$, the cooling solenoid valve 315A is closed in a step S40, and the pump 313 is stopped in a step S41.

Then, it is determined whether the recording operation is further continued or not in a step S42; and if YES, the sequence returns to the step S34 again, thus continuing the detection of the temperature. On the other hand, if NO (not continued), the liquid supplying solenoid valve 314 and the vent valve 316 of the tank 37 are closed in a step S43.

Figure 4:
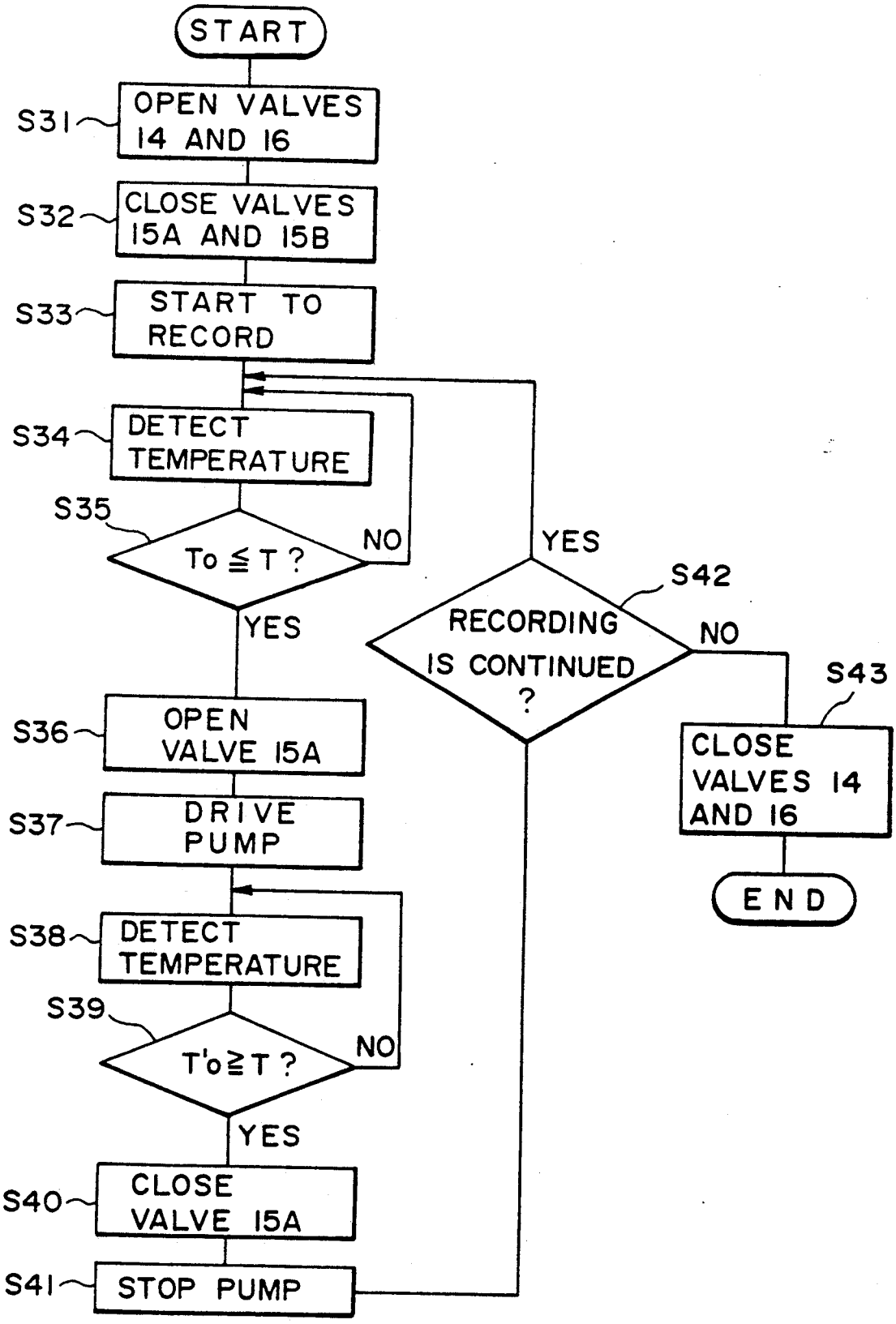
FIG. 4 is a flow chart for explaining an example of a control sequence of the liquid injection recording apparatus of the second embodiment.

Further, although not shown in FIG. 4, when the restoring operation is desired, the solenoid valve 314 is closed and the circulating solenoid valve 315B is opened, and the pump 313 is driven to discharge the recording liquid from the discharge openings 32.

Furthermore, if the recording operation may be temporarily stopped when the temperature of the recording head 31 is increased, it is possible to control, for quickly cooling the head, by circulating the recording liquid through both the secondary chamber 39 and the common liquid chamber 33.

Incidentally, in the illustrated second embodiment, although an example that the recording head 31 is cooled through the recording liquid only by the circulation of the recording liquid by means of the pump 313 was described, it is possible to further provide a fan 318, shown in FIG. 3C, to cool the recording head 31 directly while circulating the recording liquid or to cool the recording liquid being circulated, thus shortening the cooling time and accordingly shut-down time of the apparatus, thereby improving the efficiency of the recording operation.

As mentioned above, according to the second embodiment of the present invention, even if the temperature of the recording head is increased, since the recording head can be quickly cooled through the recording liquid by circulating the recording liquid between the secondary chamber in the recording head and the tank by means of the pump, even when the recording operation is not stopped, the temperature of the recording head can be decreased, thus carrying out the high speed recording operation effectively with high quality while maintaining stable discharging operation of the liquid.

Of course, the temperature when the circulation of the recording liquid is stopped is not limited to the above-mentioned lower limit temperature $T_0'$ suitable to the recording operation. That is to say, such temperature can be set to any temperature $T_0''$ between the lower limit temperature $T_0'$ suitable to the recording operation and the upper limit temperature $T_0$. In other words, the temperature $T_0''$ may meet the relation $T_0' \leqq T_0'' \leqq T_0$. However, if the temperature $T_0''$ is near the temperature $T_0$, since the liquid circulation mode is started again shortly after the recording operation is re-started, the temperature $T_0''$ should preferably be set to a value near the temperature $T_0'$, and more preferably set to the relation $T_0''=T_0'$. However, since it may be the case that the temperature of the recording head cannot be lowered to the temperature $T_0'$ by the circulation of the recording liquid, it is desirable to set temperature $T_0''$ properly.

Further, when the recording liquid in the common liquid chamber as well as the recording liquid in the secondary chamber is circulated, an amount of the recording liquid to be circulated can be suitably selected experimentally on the basis of the cooling ability of the liquid; however, it is desirable to set the circulating amount of the liquid to the extent that the recording liquid does not leak from the discharge ports while being circulated, thus shortening the shut-down time of the apparatus and preventing contamination of the recording medium.

What is claimed is:

1. An ink jet recording apparatus comprising:

a recording head of a full-line type having a plurality of discharge ports provided across a recording medium, a liquid path communicated with said discharge ports and having a thermal energy generating member for generating energy utilized to discharge recording liquid, and a common liquid chamber for storing liquid to be supplied to said liquid path, wherein said energy generating member, said liquid path and said common liquid chamber are disposed on one side of a substrate;

a chamber disposed on a reverse side of said substrate with respect to said one side of said substrate and extending along the longitudinal direction of said recording head for containing moving liquid therein, said chamber being provided independently from said common liquid chamber;

a temperature sensor which detects the temperature of said recording head during recording wherein the moving liquid in said chamber is circulated when said temperature sensor detects that the temperature of said recording head exceeds a predetermined temperature; and fan means for supplying cooling air in response to circulation of the moving liquid.

2. An ink jet recording apparatus according to claim 1, wherein the liquid is discharged in a direction different from a flow direction of moving liquid in said common liquid chamber.

3. An ink jet recording apparatus according to claim 1, wherein the moving liquid contained in said chamber is circulated to release heat generated by the recording head during recording when it is determined that the temperature of the recording head exceeds a predetermined temperature.

4. An ink jet recording apparatus according to claim 1, wherein the moving liquid comprises recording liquid.

5. An ink jet recording apparatus comprising:

a recording head of a full-line type having a plurality of discharge ports provided across a recording medium, a liquid path communicated with said discharge ports and having a thermal energy generating member for generating energy utilized to discharge recording liquid, and a common liquid chamber for storing liquid to be supplied to said liquid path, wherein said energy generating member, said liquid path and said common liquid chamber are disposed on one side of a substrate;

a chamber disposed on an area which is on a reverse side of said substrate with respect to said one side of said substrate and opposed to said energy generating member through said substrate, and extending along the longitudinal direction of said recording head for containing moving liquid therein, said chamber being provided independently from said common liquid chamber, wherein a first liquid flow is formed in a first direction with respect to an arrangement direction of said thermal energy generating member in said common liquid chamber, and a second liquid flow is formed in a second direction opposite to said first direction in said chamber;

a temperature sensor which detects the temperature of said recording head during recording wherein the moving liquid forming the second liquid flow is circulated in the second direction when said temperature sensor detects that the temperature of said recording head exceeds a predetermined temperature; and fan means for supplying cooling air in response to the circulation of the moving liquid in the second flow.

6. An ink jet recording apparatus according to claim 5, wherein moving liquid forming the second liquid flow within said chamber is circulated in the second direction to release heat generated by the recording head during recording when it is determined that the temperature of the recording head exceeds a predetermined temperature.

7. An ink jet recording apparatus according to claim 5, wherein the moving liquid comprises recording liquid.

8. A recording head comprising:

a plurality of heat generating elements provided in a predetermined distribution to record by generating heat;

a liquid path, having said heat generating elements therein, for guiding recording liquid discharged from a discharge port by utilizing thermal energy generated by said heat generating elements;

a first flow path communicating with said liquid path to supply the recording liquid to said liquid path, for forming a first liquid flow in a direction across said liquid path;

a second flow path provided independently from said first flow path through a substrate containing said heat generating elements, for forming a second liquid flow of moving liquid in a direction opposite to the direction of said first liquid flow;

a temperature sensor which detects the temperature of said recording head during recording, wherein the moving liquid forming the second liquid flow is circulated within the second flow path when said temperature sensor detects that the temperature of said recording head exceeds a predetermined temperature; and fan means for supplying cooling air in response to the circulation of the moving liquid in the second flow path.

9. An ink jet recording apparatus according to claim 5, wherein moving liquid forming the second liquid flow is circulated within the second flow path to release heat generated by the recording head during recording when it is determined that the temperature of the recording head exceeds a predetermined temperature.

10. A recording head according to claim 8, wherein the moving liquid comprises recording liquid.

11. A method for controlling the temperature of a recording head which utilizes heat for recording, said method comprising the steps of:

recording using said recording head;

supplying recording liquid stored in a common liquid chamber to discharge ports of said recording head by way of a liquid path, said common liquid chamber and liquid path disposed on one side of a substrate;

detecting a temperature change of said recording head during said recording;

selectively circulating a moving liquid within a secondary chamber on a back side of the substrate without interrupting recording by said recording head and circulating said moving liquid within said secondary chamber and said recording liquid within said common liquid chamber while interrupting recording by said recording head, in order to cool said recording head when the temperature rises above a predetermined range; and supplying air to remove heat from said moving liquid when said moving liquid is circulated.

12. A method for controlling the temperature of a recording head according to claim 11, wherein the circulated moving liquid comprises recording liquid.

13. A method for controlling the temperature of a recording head according to claim 11, wherein said recording head is a full-line type having a plurality of discharge ports provided across a recording medium.

14. A method according to claim 11, wherein said moving liquid is circulated while said recording is taking place.

15. A method according to claim 11, wherein said recording liquid is circulated while said recording is not taking place.

16. A method according to claim 11, wherein said recording liquid and said recording liquid are circulated while said recording is not taking place.

* * * * *

UNITED STATES PATENT AND TRADEMARK OFFICE

CERTIFICATE OF CORRECTION

PATENT NO. : 5,291,215

DATED : March 1, 1994

INVENTOR(S) : MINORU NOZAWA, ET AL.

It is certified that error appears in the above-identified patent and that said Letters Patent is hereby corrected as shown below:

ON TITLE PAGE

In [56] References Cited, under FOREIGN PATENT DOCUMENTS:
"61-206658 3/1986 Japan ." should read
--61-206658 9/1986 Japan .--; and
"206658 10/1992 Japan ." should be deleted.

COLUMN 1

Line 15, "apparatus in," should read --apparatus,--.
Line 16, "which" should read --in which--.
Line 67, "resulting" should read --resulting in--.

COLUMN 3

Line 10, "common chamber;" should read --common liquid chamber;--.

COLUMN 5

Line 46, "disenergized" should read --deenergized--.

COLUMN 6

Line 47, "5" should read --35--.

COLUMN 7

Line 20, "disenergization" should read --deenergization--.

UNITED STATES PATENT AND TRADEMARK OFFICE

CERTIFICATE OF CORRECTION

PATENT NO. : 5,291,215

DATED : March 1, 1994

INVENTOR(S) : MINORU NOZAWA, ET AL.

It is certified that error appears in the above-identified patent and that said Letters Patent is hereby corrected as shown below:

COLUMN 10

Line 35, "5," should read --8,-- and "moving" should read --the moving--.

COLUMN 12

Line 4, "recording liquid" (first occurrence) should read --moving liquid--.

Signed and Sealed this

Twentieth Day of September, 1994

Bruce Lehman

*Attest:*

BRUCE LEHMAN

*Attesting Officer*

*Commissioner of Patents and Trademarks*

--